US007553139B2

(12) United States Patent
Amburgey et al.

(10) Patent No.: US 7,553,139 B2
(45) Date of Patent: Jun. 30, 2009

(54) PROGRESSING CAVITY PUMP WITH WOBBLE STATOR AND MAGNETIC DRIVE

(75) Inventors: Michael Duane Amburgey, London, OH (US); Jose L. Sandoval, Jamestown, OH (US)

(73) Assignee: Moyno, Inc., Springfield, OH (US)

( * ) Notice: Subject to any disclaimer, the term of this patent is extended or adjusted under 35 U.S.C. 154(b) by 0 days.

(21) Appl. No.: 11/865,323

(22) Filed: Oct. 1, 2007

(65) Prior Publication Data

US 2008/0085203 A1 Apr. 10, 2008

Related U.S. Application Data

(60) Provisional application No. 60/850,199, filed on Oct. 6, 2006.

(51) Int. Cl.
*F01C 1/10* (2006.01)
*F03C 2/00* (2006.01)
*F04C 18/00* (2006.01)

(52) U.S. Cl. ..... 418/48; 418/152; 417/410.4; 417/420

(58) Field of Classification Search ..... 418/48, 418/152, 161, 178, 182; 417/410.4, 420, 417/356, 410.1
See application file for complete search history.

(56) References Cited

U.S. PATENT DOCUMENTS 2,512,764 A 6/1950 Byram
2,545,604 A * 3/1951 Byram ..... 418/48
2,612,845 A 10/1952 Byram et al.
3,238,883 A 3/1966 Martin
3,286,642 A * 11/1966 Lindberg ..... 418/48
3,479,960 A * 11/1969 Cardoso ..... 418/48
RE29,180 E 4/1977 Clark
4,135,863 A * 1/1979 Davis et al. ..... 417/420
4,802,827 A * 2/1989 Fujiwara et al. ..... 418/48
5,549,464 A * 8/1996 Varadan ..... 418/48
5,807,087 A 9/1998 Brandt et al.
6,120,267 A 9/2000 Cunningham
6,371,487 B1 4/2002 Cimbura, Sr.
6,491,501 B1 12/2002 Wild et al.
7,074,018 B2 7/2006 Chang

FOREIGN PATENT DOCUMENTS

DE 2418967 10/1975
DE 4313442 10/1994

(Continued)

OTHER PUBLICATIONS

European Search Report issued regarding European Application No. 07117841.2 (Jan. 28, 2008).

*Primary Examiner*—Theresa Trieu
(74) *Attorney, Agent, or Firm*—Thompson Hine LLP

(57) ABSTRACT

A progressing cavity pump including a drive component configured to be rotated by a motor and a driven component that is magnetically rotationally coupled to the drive component. The driven component is fluidly isolated from the drive component. The pump further includes a wobble stator and a rotor positioned inside the stator and configured such that rotation of the driven component causes relative rotation between the rotor and the stator, which in turn causes material in the pump to be pumped therethrough.

27 Claims, 4 Drawing Sheets

FOREIGN PATENT DOCUMENTS

| | | |
|---|---|---|
| DE | 19842754 | 4/2000 |
| GB | 699438 | 11/1953 |
| JP | 2005-315188 | 11/2005 |
| WO | 94/25758 | 11/1994 |
| WO | 2006/015218 | 9/2006 |
| WO | 2008/000506 | 1/2008 |

* cited by examiner

PROGRESSING CAVITY PUMP WITH WOBBLE STATOR AND MAGNETIC DRIVE

This application claims priority to U.S. Provisional Application Ser. No. 60/850,199, filed on Oct. 6, 2006, the entire contents of which are hereby incorporated by reference.

The present invention is directed to a progressing cavity pump, and more particularly, a progressing cavity pump which includes a wobble stator and/or a magnetic drive.

BACKGROUND

Progressing cavity pumps may be used to pump a variety of materials, including chemical materials that may be relatively corrosive or caustic. The present invention provides a pump design which can accommodate these relatively corrosive or caustic chemicals by providing various sealing arrangements, fluid isolation arrangements, and other features.

SUMMARY

In one embodiment, the present invention is a progressing cavity pump including a drive component configured to be rotated by a motor and a driven component that is magnetically rotationally coupled to the drive component. The driven component is fluidly isolated from the drive component. The pump further includes a wobble stator and a rotor positioned inside the stator and configured such that rotation of the driven component causes relative rotation between the rotor and the stator, which in turn causes material in the pump to be pumped therethrough.

In another embodiment the invention is a method for operating a progressing cavity pump including the step of providing a progressing cavity pump including a drive component, a driven component, a wobble stator, and a rotor positioned inside the stator. The method further includes the step of causing the drive component to be rotated which thereby magnetically causes the driven component to be rotated. Rotation of the driven component causes relative rotation between the rotor and the stator which in turn causes material in the pump to be pumped therethrough.

DETAILED DESCRIPTION

Figure 1:
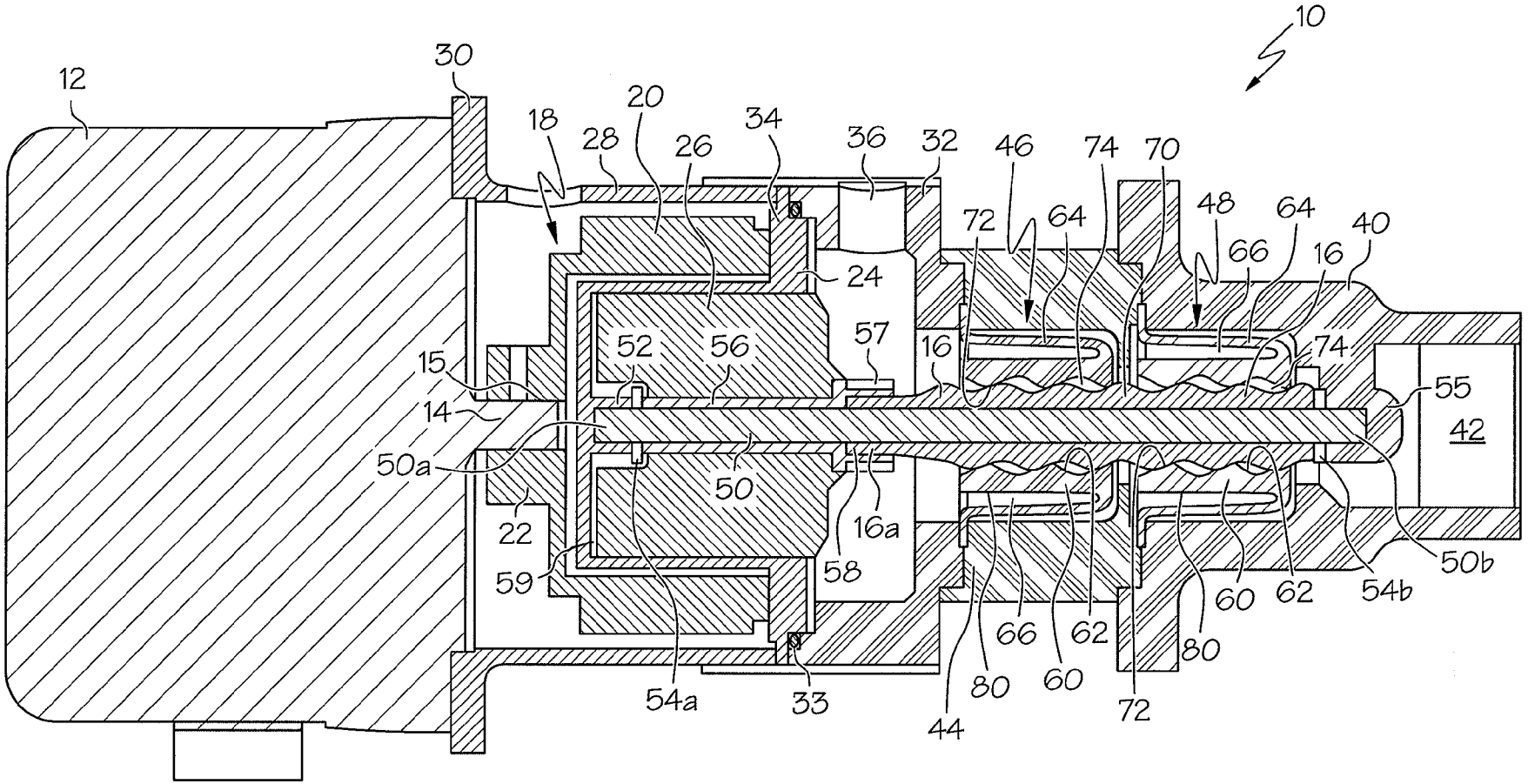
FIG. 1 is a side cross section of one embodiment of the pump of the present invention.

With reference to the attached figures, the progressing cavity pump 10 of the present invention may utilize a standard motor, gearbox or gearmotor 12 which rotationally drives an output shaft or drive shaft 14. In order to rotationally couple the drive shaft 14 to the rotor 16 of the pump 10, a magnetic drive coupling system 18 may be utilized. More particularly, the magnetic drive coupling system 18 may include a generally cylindrical outer magnet, or drive magnet/component 20 that is mechanically rotationally coupled to the drive shaft 14. The drive shaft 14 may have a key slot or "flat" 15, and the outer magnet 20 may have a sleeve 22 which closely receives the drive shaft 14 therein to rotationally couple the outer magnet 20 and the drive shaft 14. However, various other mechanisms or means may be used to rotationally couple the drive shaft 14 and outer magnet 20 such as the use of a interengaging geometries, pin, bolt, split washer, compressive fittings, fasteners, etc. These attachment methods, as well as various other mechanisms or means, may also be used for making the other rotational couplings disclosed herein.

The outer magnet 20 receives a generally cylindrical shroud or seal 24 therein, and a generally cylindrical inner magnet or driven magnet/component 26 is received inside the shroud 24. As will be described in greater detail below, the shroud 24 helps to provide fluid isolation to the pump 10. For example, the inner magnet 26 may be fluidly exposed to the materials moved/pumped by the pump 10, and the shroud 24 helps to contain the pumped materials therein, and also fluidly isolated the outer magnet 20 and other components.

Thus, in the illustrated embodiment, a seal in the form of the shroud 24 is positioned between the inner 26 and outer 20 magnets to fluidly isolate those components. The shroud 24 enables full magnetic interaction between the inner 26 and outer 20 magnets, while still providing fluid isolation. The shroud 24 may be removable and replaceable as the shroud 24 wears.

The outer magnet 20, shroud 24 and inner magnet 26 are received in an outer casing 28 having a mounting flange 30 which can be used to couple the outer casing 28 to the motor 12. The outer casing 28 is coupled to a discharge housing 32, and the shroud 24 is positioned between the outer casing 28 and the discharge housing 32. More particularly, the shroud 24 includes an outwardly-extending flange portion 34 positioned between the outer casing 28 and discharge housing 32. The flange portion 34 also provides a seat for an O-ring 33 which provides a fluid-tight seal between the outer casing 28/shroud 24 and the discharge housing 32.

The discharge housing 32 is generally cylindrical and includes a laterally-extending discharge port 36 through which pumped material exits the pump 10. The discharge housing 32 is coupled to a generally cylindrical inlet/suction housing 40 which includes an axially-extending inlet port 42 through which materials to be pumped enter the pump 10. In the illustrated embodiment, a generally cylindrical transition piece 44 is positioned between the discharge housing 32 and the suction housing 40.

The pump 10 includes the rotor 16 positioned within, and extending through, a pair of stators 46, 48. As will be described in greater detail below, the pump 10 may include more or less than two stators. The rotor 16 is mounted on an alignment shaft 50 that is positioned within the pump 10 and extends a significant portion of the length of the pump 10. The alignment shaft 50 may be made of a relatively hard material, such as ceramic, and may be made of materials that are inert to any chemicals being pumped and which provides high durability.

The outlet end 50*a* of the shaft 50 is fixedly (i.e. non-rotatably) mounted to the shroud 24, such as by inserting an eccentric end 50*a* of the alignment shaft 50 into a correspondingly-shaped sleeve 52 on the shroud 24. The inlet end 50*b* of the alignment shaft 50 is similarly fixedly or non-rotatably mounted to the suction housing 40. More particularly, in the illustrated embodiment the suction housing 40 includes a cantilevered end flange 55 which closely receives the eccentric inlet end 50*b* of the alignment shaft 50 therein. Of course, various other methods of mounting and retaining the alignment shaft 50 may be utilized.

Thrust washers 54*a*, 54*b* are located at opposite ends of the alignment shaft 50 to accommodate axial/thrust loading of the shaft 50. More particularly, during operation of the pump 10 the thrust washers 54*a*, 54*b* carry the axial load that would otherwise be imposed on the alignment shaft 50, and therefore reduce wear upon the shaft 50, sleeve 52 and flange 55. The thrust washers 54*a*, 54*b* also help to keep the shaft 50 aligned and held in place. The thrust washers 54*a*, 54*b* also aid in assembly of the pump by holding the shaft 50 in place as other component are built up upon the shaft 50. The thrust washers 54*a*, 54*b* may be made of a relatively hard inert material, such as ceramic.

A generally cylindrical bushing 56 is rotationally coupled to the inner surface of the inner magnet 26, such as by an interference fit, adhesives or mechanical means. The bushing 56 can be made of a variety of materials, such as carbon, and includes an opening 58 at a distal end thereof. The opening 58 receives an outlet end 16*a* of the rotor 16 therein. The outlet end 16*a* of the rotor 16 can be coupled to the bushing 56 by a variety of manners such as by an interference fit, by interengaging geometries, pins, bolts, split washer, a cylindrical clamping component 57 or the like. In this manner the bushing 56, inner magnet 26 and rotor 16 are rotatable about the alignment shaft 50, and the alignment shaft 50 provides a radial bearing surface for the rotor 16.

Figure 2:
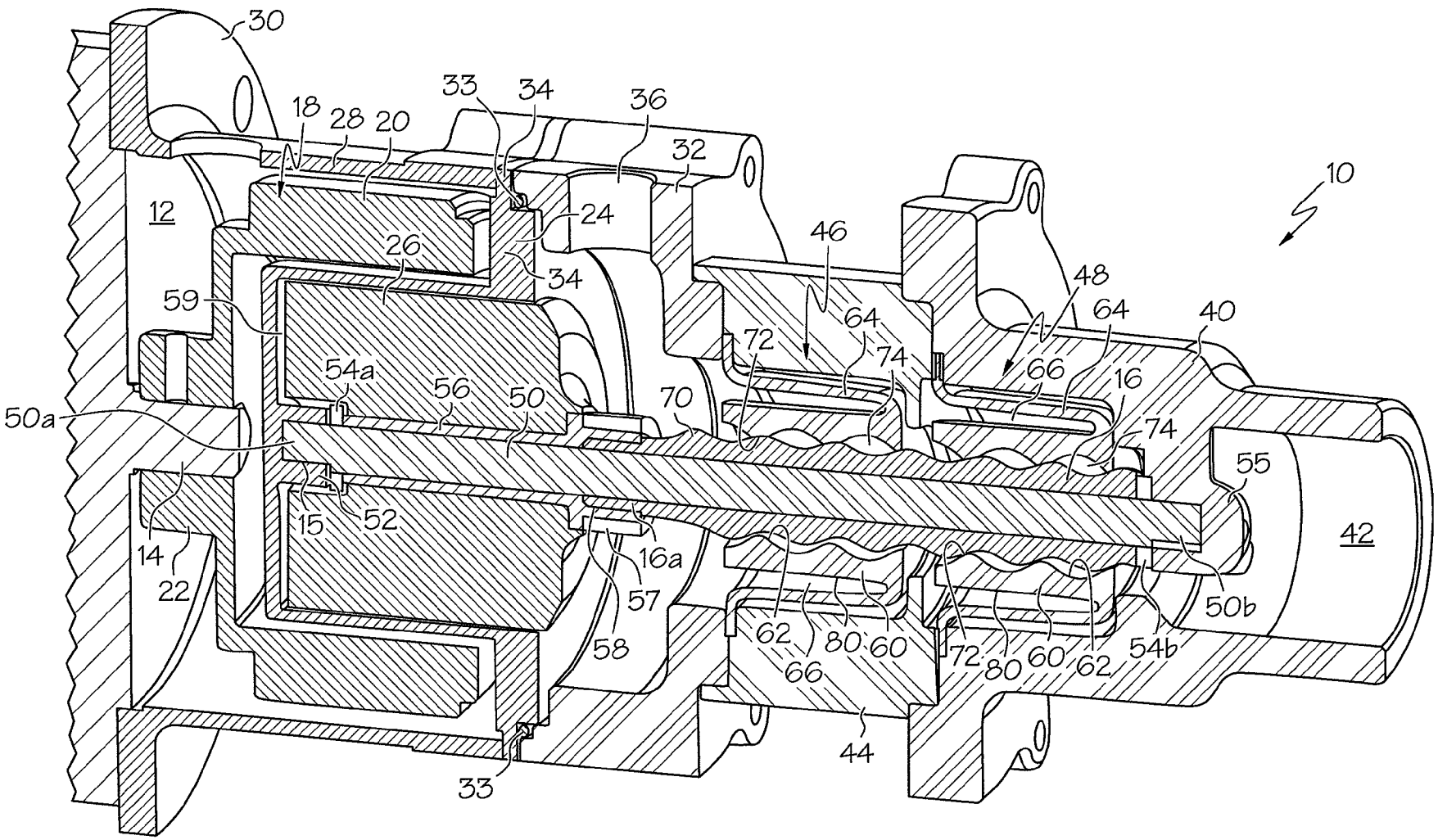
FIG. 2 is a side cross section perspective view of the pump of FIG. 1.
Figure 3:
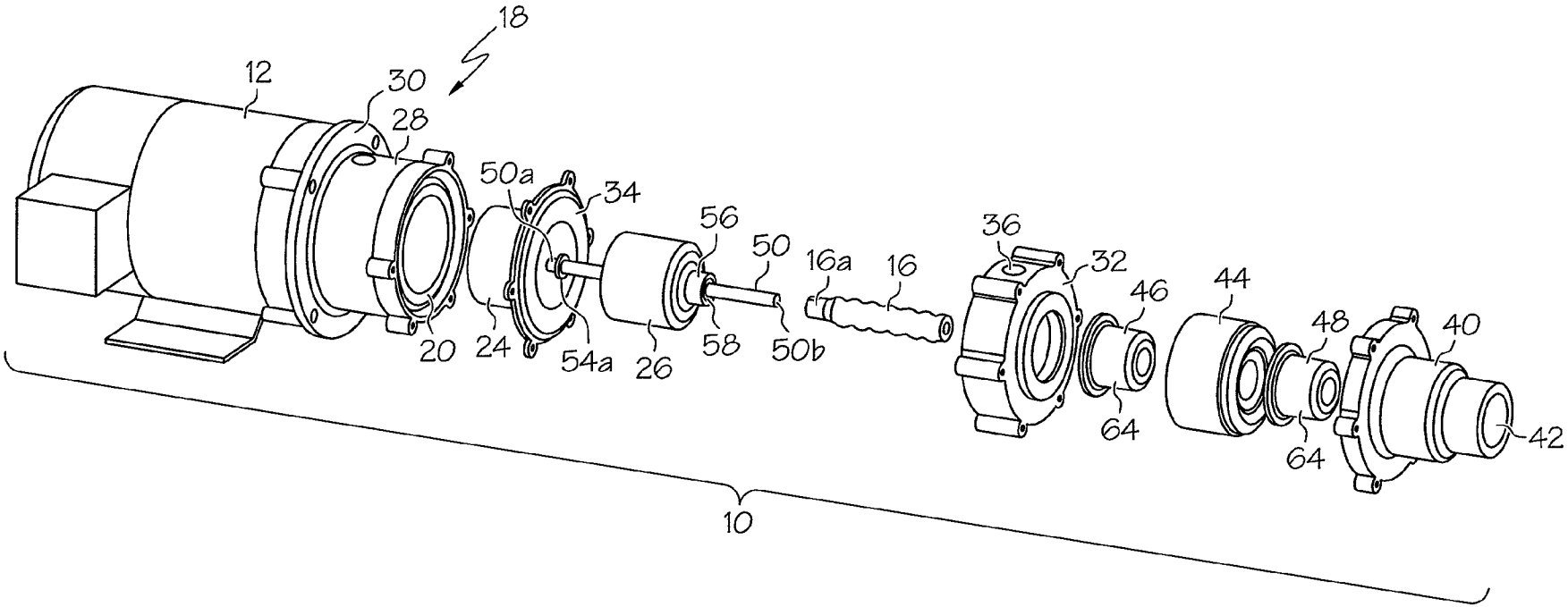
FIG. 3 is an exploded perspective view of the pump of FIG. 1.
Figure 4:
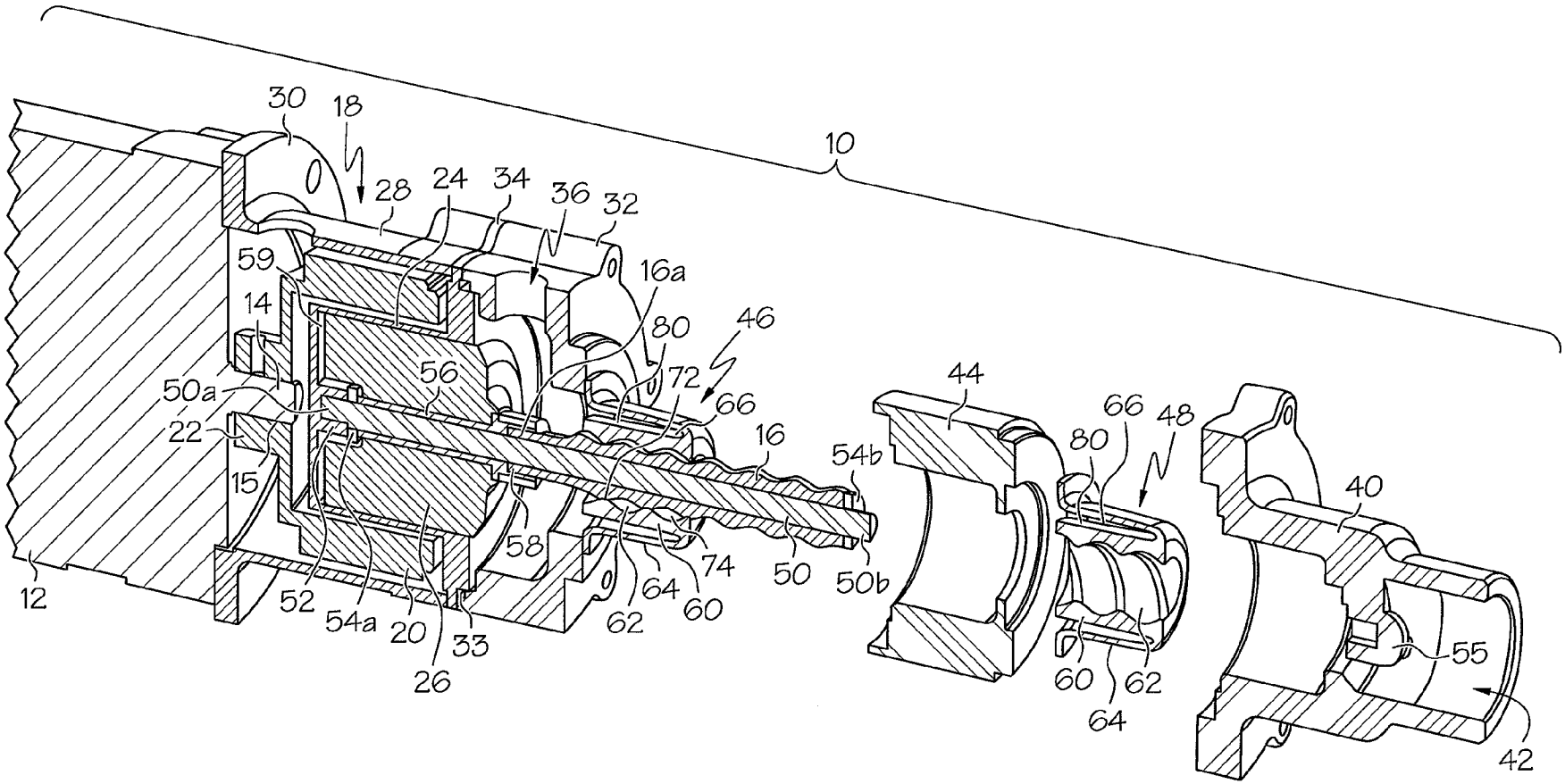
FIG. 4 is a partially exploded side cross section view of the pump of FIG. 1.

The inner magnet 26 is slidable in an axial direction along the bushing 56. More particularly, there may be a small gap or clearance (i.e. gap 59 of FIG. 2) to allow the inner magnet 26 to move or expand axially, but such movement is constrained by the shroud 24 and the end of the bushing 56 defining the mouth 58. Thus the inner magnet 26 may be unbounded along one axial end to allow for thermal expansions or movement. The inner magnet 26 may have a relatively high thermal mass, and this arrangement allows the inner magnet 26 to expand, such as due to thermal expansion, without causing damage to the pump 10. As can be seen the outer magnet 20 may be generally unbounded to allow thermal expansion thereof.

The rotor 16 extends through, and is received in, the pair of stators 46, 48. The rotor 16 can be made of any of a variety of materials, but may have more flexibility and/or ductility than the material of the alignment shaft 50 to allow the rotor 16 to accommodate bending stresses imposed thereon. In any case the rotor 16 may be made of a material that is also chemically inert and wear resistant, although the rotor 16 need not necessarily have these characteristics.

The downstream stator 46 is mounted inside the transition housing 44, and upstream stator 48 is mounted inside the suction housing 40. Each stator 46, 48 includes a generally cylindrical central core 60 which defines an inner bore 62, and a generally cylindrical outer skirt 64 which surrounds the central core 60. Each skirt 64 is spaced apart from the associated central core 60 to define a gap 66 therebetween.

The stators 46, 48 may be made of a resilient and/or flexible elastomeric material. As will be described in greater detail below the stators 46, 48 may need to be resilient and/or flexible to provide for proper operating of the pump 10. For example the stators 46, 48 may be made of elastomers, nitrile rubber, natural rubber, synthetic rubber, fluoroelastomer rubber, urethane, ethylene-propylene-diene monomer ("EPDM") rubber, polyolefin resins, perfluoroelastomer, hydrogenated nitriles and hydrogenated nitrile rubbers, polyurethane, epichlorohydrin polymers, thermoplastic polymers, polytetrafluoroethylene ("PTFE"), polychloroprene (such as Neoprene), synthetic rubber or rubber compositions, such as VITON® materials sold by E. I. du Pont de Nemours and Company located in Wilmington Del., synthetic elastomers such as HYPALON® polyolefin resins and synthetic elastomers sold by E. I. du Pont de Nemours and Company, synthetic rubber such as KALREZ® synthetic rubber sold by E. I. du Pont de Nemours and Company, tetrafluoroethylene/propylene copolymer such as AFLAS® tetrafluoroethylene/propylene copolymer sold by Asahi Glass Co., Ltd. of Tokyo, Japan, acid-olefin interpolymers such as CHEMROZ® acid-olefin interpolymers sold by Chemfax, Incorporated of Gulfport Miss., and various other materials.

The rotor 16 may be made of a relatively rigid material, such as steel, carbon steel, tool steel, TEFLON® fluorinated hydrocarbons and polymers sold by E.I. duPont de Nemours and Company, A2 tool steel, 17-4 PH stainless steel, crucible steel, 4150 steel, 4140 steel or 1018 steel, thermoplastics, RYTON® thermoplastics or resins sold by Chevron Phillips Chemical Company of Woodlands Tex., KYNAR® fluorine-containing synthetic resin, sold by Arkema, Inc. of Philadelphia, Pa., or other suitable materials which can be cast, machined or injection molded. When the rotor 16 is made of a relatively rigid material, this can increase the strength and durability of the rotor 16.

The rotor 16 may be an externally threaded rotor 16 in the form of a single lead helical screw. Each stator 46, 48 has an opening or internal bore 62 extending generally longitudinally therethrough in the form of a double lead helical nut to provide an internally threaded stator 46, 48. The rotor 16 may include a single external helical lobe 70, with the pitch of the lobe 70 being twice the pitch of the internal helical grooves 62 of the stators 46, 48.

The pitch length of the stators 46, 48 may be twice that of the rotor 16, and the illustrated embodiment shows a rotor/stator assembly combination known as 1:2 profile elements, which means the rotor 16 has a single lead and the stators 46, 48 each have two leads. However, the present invention can also be used with any of a variety of rotor/stator configurations, including more complex progressing cavity pumps such as 9:10 designs where the rotor has nine leads and the stators have ten leads. In general, nearly any combination of leads may be used so long as the stators 46, 48 have one more lead than the rotor 16. U.S. Pat. Nos. 2,512,764, 2,612,845, and 6,120,267, the contents of which are hereby incorporated by reference, provide additional information on the operation and construction of progressing cavity pumps.

The rotor 16 and stators 46, 48 provide a series of helical seal lines 72 where the rotor 16 and stators 46, 48 contact each other, or come in close proximity to each other. In this manner the external helical lobe 70 of the rotor 16 and the internal helical grooves 62 of the stators 46, 48 define a plurality of cavities 74 therebetween. The seal lines 72 define or seal off defined, discrete cavities 74 bounded by the rotor 16 and stator 46, 48 surfaces.

In order to operate the pump 10, the motor 12 rotationally drives the output shaft 14, which in turn causes the outer magnet 20 to rotate. The magnetic forces/interaction between the outer 20 and inner 26 magnets causes the inner magnet 26 to rotate within the shroud 24. The rotation of the inner magnet 26, in turn, causes the bushing 56 to rotate, which correspondingly causes the rotor 16 to rotate about the shaft 50 and within the stators 46, 48.

It should be noted that instead of being made of an inherently magnetic material, the inner magnet 26 may be made of a magnetizable material (i.e. a ferrous material or the like) that is magnetically attracted to the outer magnet 20. Alternately, the inner magnet 26 may be made of a magnetic material and the outer magnet 20 may be made of a magnetizable material. However, in either case, at least one of the inner 26 or outer 20 magnets may be made of a permanently magnetic material.

As the rotor 16 turns within the stators 46, 48, the cavities 74 progress from the inlet or suction end of the rotor/stator pair to an outlet or discharge end of the rotor/stator pair.

During a single 360° revolution of the rotor 16, one set of cavities 74 is opened or created at the inlet 42 at exactly the same rate that a second set of cavities 74 is closing or terminating at the outlet 36 which results in a predictable, pulsationless flow of pumped fluid. Thus, rotation of the rotor 16 inside the stators 46, 48 pumps material located in the pump 10 from the inlet 42 to the outlet 36.

When the rotor 16 is rotated about its central axis, the central core 60 of each stator 46, 48 moves or is deformed radially, or "wobbles" to accommodate the eccentric rotation of the outer surface/helical lobe 70 of the rotor 16. Thus each stator 46, 48 constitutes what is known as a eccentric stator or a wobble stator, and should be sufficient flexible to accommodate this wobbling motion. The gap 66 in each stator 46, 48 provides sufficient clearance to accommodate wobbling of the central core 60 of each stator 46, 48.

The rotor 16 may be concentrically mounted on its center axis, and the stators 46, 48 may be eccentrically positioned with respect to the center axis. In this arrangement, the rotor 16 rotates smoothly about the alignment shaft 50 and its central axis does not shift radially; instead any radial movement is accommodated by the stators 46, 48. Thus, in this arrangement, a universal joint coupling to the rotor 16 is not needed. The elimination of the universal joint can provide cost savings and reduce the complexity and part count of the pump 10. Moreover, the magnetic drive 18 provides a sealed drive system and helps to ensure any materials being pumped (such as corrosive materials or the like) to not escape via the drive coupling.

If desired a relatively rigid sleeve or the like (not shown) can be positioned on the outer surface 80 of the inner core 60 of one or more of the stators 46, 48. Such a sleeve provide a restrictive feature that limits the flexibility of the stators 46, 48 and therefore limits the wobbling thereof and varies the properties of the pump 10 as desired. For example, the use of the sleeves can allow the pump 10 to provide greater pressure capabilities.

The illustrated embodiment shows a pump 10 with the transition piece 44 having a stator 46 received therein. If desired, additional transition pieces, with stators located therein, can be positioned between the discharge housing 32 and suction housing 40. In addition, if desired the transition piece 44 can be removed and the discharge housing 32 can be directly coupled to the suction housing 40. Thus this flexibility allows the pump 10 to be staged or arranged as desired with any number of stators in a modular manner, although varying lengths of stators 16 and shafts 50 may need to be installed to accommodate differing numbers of stators.

The pump 10 may be used to pump corrosive chemicals or the like. In this case all of the wetted surfaces of the pump 10 may be made of or coated with an inert and/or corrosion resistant materials. For example, discharge housing 32, suction housing 40, rotor 16, shroud 24, and transition piece 44 may each be made of can be made of or coated with a thermoplastic or resin material, or any chemically inert plastic or polymer material. One such material is RYTON® thermoplastics or resins. The inner magnet 26 may also be covered with such a protective coating. However, the materials and/or wetted surface of the pump 10 can be made of any of a wide variety of materials, such as nearly chemically inert plastic, polymer, or resin material.

The shroud 24 generally surrounds the inner magnet 26 and, along with the seal 33, seals and protects the downstream component of the pump 10 (i.e. the outer magnet 20 and motor 12) from the material being pumped. In addition, due to the magnetic drive coupling, no direct mechanical drive connections to the inside of the pump 10 are required, as the magnetic drive forces are transmitted through the (sealed) shroud 24. Thus the magnet drive arrangement provides greater integrity to the pump 10 and eliminates the need for mechanical seals. Therefore a close-coupled, seal-less plastic pump is provided.

Having described the invention in detail and by reference to the preferred embodiments, it will be apparent that modifications and variations thereof are possible without departing from the scope of the invention.

What is claimed is:

1. A progressing cavity pump comprising:

a drive component configured to be rotated by a motor;

a driven component that is magnetically rotationally coupled to said drive component, wherein said driven component is fluidly isolated from said drive component;

a wobble stator;

a rotor positioned inside said stator and configured such that rotation of said driven component causes relative rotation between said rotor and said stator, which in turn causes material in said pump to be pumped therethrough; and an alignment shaft which supports said rotor thereon, wherein said rotor is rotatable relative to said alignment shaft.

2. The pump of claim 1 wherein said drive component and said driven component are both made of permanently magnetized material.

3. The pump of claim 1 wherein one of said drive component or said driven component is made of a permanently magnetized material, and wherein the other one of said drive component or said driven component is made of a magnetizable material.

4. The progressing cavity pump of claim 1 wherein said drive component is positioned generally radially outwardly relative to said driven component, and wherein a seal is positioned radially between said drive component and said driven component to generally fluidly isolate said driven component and said drive component.

5. The progressing cavity pump of claim 1 wherein one of said drive component or said driven component is directly fluidly exposed to the materials pumped through said pump, and wherein the other one of said drive component or said driven component is fluidly isolated from the materials pumped through said pump.

6. The progressing cavity pump of claim 1 wherein said drive component is directly rotationally coupled to said rotor.

7. The progressing cavity pump of claim 1 wherein generally all wetted surfaces of said pump are made of or coated with an inert or corrosion resistant material such that said pump is arranged to pump corrosive materials.

8. The progressing cavity pump of claim 1 wherein said alignment shaft at least partially extends through said drive component and said driven component.

9. The progressing cavity pump of claim 1 wherein said wobble stator includes a central core closely receiving the rotor therein, and a skirt radially spaced apart from said central core such that a gap is defined between said central core and said skirt, and wherein said central core wobbles relative to said skirt when there is relative rotation between said stator and said rotor.

10. The progressing cavity pump of claim 1 wherein said rotor is configured to rotate about a concentric axis, and wherein said wobble stator is eccentrically positioned relative to said concentric axis of said rotor.

11. The progressing cavity pump of claim 1 wherein said rotor has a greater stiffness than said stator.

12. The progressing cavity pump of claim 1 further including a supplemental wobble stator, wherein said rotor is positioned inside said supplemental stator such that relative rotation between said rotor and said supplemental stator causes material in said supplement stator to be pumped therethrough.

13. The progressing cavity pump of claim 1 wherein said pump is configured to receive one or more supplemental wobble stators thereon in a modular manner.

14. The progressing cavity pump of claim 1 further comprising a motor rotationally coupled to said drive component to rotate said drive component.

15. The progressing cavity pump of claim 14 wherein said motor is mounted in a close coupled manner.

16. The progressing cavity pump of claim 1 wherein said driven component is unbounded on at least one axial end thereof to allow said driven component to expand in the axial direction to accommodate thermal or other expansions or movements thereof.

17. The pump of claim 1 wherein said rotor is a helical nut and wherein said stator includes a helical bore receiving said helical nut rotor therein.

18. The pump of claim 1 wherein said stator and rotor define a plurality of cavities therebetween, and wherein said cavities progress along a length of said pump when said rotor is rotated relative to said stator.

19. The pump of claim 1 further comprising a pair of supports, each support being positioned at or adjacent to an end of said alignment shaft such that the pair of supports support and stabilize said alignment shaft.

20. The pump of claim 1 wherein said wobble stator is deformed radially in all directions in a radial plane for a 360 degree rotation of said rotor.

21. The pump of claim 1 further comprising a supplemental wobble stator, and wherein said rotor is positioned inside said supplemental stator and configured such that rotation of said driven component causes relative rotation between said rotor and said supplemental stator, which in turn causes material in said pump to be pumped therethrough, wherein said each stator is deformed radially in all directions in a radial plane for a 360 degree rotation of said rotor.

22. A progressing cavity pump comprising:

a drive component configured to be rotated by a motor;

a driven component configured to be magnetically rotated by said drive component, wherein said driven component is fluidly isolated from said drive component;

a pair of stators; and a rotor positioned inside said stators and configured such that rotation of said driven component causes relative rotation between said rotor and said stators, which in turn causes material in said pump to be pumped therethrough, wherein said each stator is deformed radially in all directions in a radial plane for a 360 degree rotation of said rotor.

23. The pump of claim 22 further comprising an alignment shaft which supports said rotor thereon, wherein said rotor is rotatable relative to said alignment shaft.

24. A method for operating a progressing cavity pump comprising the steps of:

providing a progressing cavity pump including a drive component, a driven component, a wobble stator, a rotor positioned inside said stator, and an alignment shaft which supports said rotor thereon; and causing said drive component to be rotated which thereby magnetically causes said driven component to be rotated, whereby rotation of said driven component causes relative rotation between said alignment shaft and said rotor and causes relative rotation between said rotor and said stator which in turn causes material in said pump to be pumped therethrough.

25. The method of claim 24 wherein said pump of further includes a pair of supports, each support being positioned at or adjacent to an end of said alignment shaft such that the pair of supports support and stabilize said alignment shaft.

26. The method of claim 24 wherein said wobble stator is deformed radially in all directions in a radial plane for a 360 degree rotation of said rotor.

27. The method of claim 24 wherein said pump includes a supplemental wobble stator, and wherein said rotor is positioned inside said supplemental stator and configured such that rotation of said driven component causes relative rotation between said rotor and said supplemental stator, which in turn causes material in said pump to be pumped therethrough, wherein said each stator is deformed radially in all directions in a radial plane for a 360 degree rotation of said rotor.

* * * * *